US010011084B2

(12) United States Patent
Schuermann et al.

(10) Patent No.: US 10,011,084 B2
(45) Date of Patent: Jul. 3, 2018

(54) CYCLE PRESS

(75) Inventors: Klaus Schuermann, Juechen (DE); Lothar Sebastian, Duisburg (DE); Horst Weiss, Wachtendonk (DE)

(73) Assignee: SIEMPELKAMP MASCHINEN-UND ANLAGENBAU GMBH & CO. KG, Krefeld (DE)

( * ) Notice: Subject to any disclaimer, the term of this patent is extended or adjusted under 35 U.S.C. 154(b) by 1254 days.

(21) Appl. No.: 14/117,051

(22) PCT Filed: May 22, 2012

(86) PCT No.: PCT/EP2012/059501
§ 371 (c)(1),
(2), (4) Date: Dec. 4, 2013

(87) PCT Pub. No.: WO2012/163732
PCT Pub. Date: Dec. 6, 2012

(65) Prior Publication Data

US 2014/0083314 A1 Mar. 27, 2014

(30) Foreign Application Priority Data

May 27, 2011 (EP) ..... 11167899

(51) Int. Cl.

| | |
|---|---|
| ***B30B 15/04*** | (2006.01) |
| ***B30B 1/32*** | (2006.01) |
| ***B30B 1/34*** | (2006.01) |
| ***B30B 15/06*** | (2006.01) |

(52) U.S. Cl.
CPC ..... *B30B 15/042* (2013.01); *B30B 1/32* (2013.01); *B30B 1/34* (2013.01); *B30B 15/04* (2013.01); *B30B 15/065* (2013.01)

(58) Field of Classification Search
CPC ..... B30B 15/048; B30B 1/32; B30B 1/34; B30B 15/04; B30B 15/065
USPC ..... 100/269.17; 72/455
See application file for complete search history.

(56) References Cited

U.S. PATENT DOCUMENTS

| | | | | |
|---|---|---|---|---|
| 3,908,429 | A * | 9/1975 | Gram | B21D 24/00 72/336 |
| 5,027,638 | A * | 7/1991 | Friestad | B30B 15/048 100/214 |
| 6,865,984 | B2 | 3/2005 | Schuermann | |

FOREIGN PATENT DOCUMENTS

| | | | |
|---|---|---|---|
| DE | 3933076 | B | 11/1990 |
| DE | 19806708 | B | 4/1999 |
| DE | 19937694 | A | 2/2001 |
| DE | 10122967 | A | 11/2002 |

(Continued)

*Primary Examiner* — Shelley Self
*Assistant Examiner* — Joseph Finan, Jr.
(74) *Attorney, Agent, or Firm* — Andrew Wilford

(57) ABSTRACT

The invention relates to a cycle press, in particular a short-cycle press, for producing and/or coating board-shaped materials, in particular engineered wood boards, comprising a press body having several press frames arranged next to one another in the longitudinal press direction, and further comprising an upper press plate and a lower press plate, wherein pressing cylinders supported on the press frames act on the upper press plate or the lower press plate. According to the invention, said cycle press is characterized in that the pressing cylinders are attached to the press frames by means of frame pins, wherein said frame pins engage in cut-outs of the press frames. Thus, the pressing cylinders can be prestressed against the press frames.

19 Claims, 8 Drawing Sheets

(56) References Cited

FOREIGN PATENT DOCUMENTS

| | | | |
|---|---|---|---|
| DE | 102004033484 | A | 2/2006 |
| DE | 102005009298 | A | 9/2006 |
| WO | 2008043279 | A | 4/2008 |

* cited by examiner

CYCLE PRESS

CROSS REFERENCE TO RELATED APPLICATIONS

This application is the US-national stage of PCT application PCT/EP2012/059501 filed 22 May 2012 and claiming the priority of European patent application 11167899.1 itself filed 27 May 2011.

FIELD OF THE INVENTION

The invention relates to a cycle press, in particular a short-cycle press for making and/or laminating panel workpieces, in particular engineered wood boards.

BACKGROUND OF THE INVENTION

Such a press typically has a press body having a row of press frames that extends along a longitudinal press axis, and comprising an upper press platen and a lower press platen, where press cylinders supported on the press frames act on the upper or lower press platen. The press platens are heatable and thus identified as heating platens. The press cylinders, which are also identified as cylinder-piston arrangements, are typically provided in a plurality of rows that extend along the longitudinal press axis, each row having a plurality of cylinder-piston arrangements. The press cylinders are preferably provided in the form of hydraulic cylinders. This type of press, also identified as a single-daylight press, operates cyclically, i.e. the starting materials are introduced in cycles into the press (between the upper press platen and the lower press platen), and the press cycles open and closed. The press frames forming the press body are composed of cut-to-size sheet steels formed with windows.

Cycle presses of the above-described type are well known that are found in a wide variety of embodiments (see, DE 199 37 694 or DE 101 22 967). DE 101 22 967 describes a cycle press, in particular a short-cycle press for making particle board, fiberboard, plywood, or the like in which a pressure medium can act on the press cylinders, either individually and/or in predetermined groups, with application of the pressure on the press cylinders effected in a preprogrammed manner with a pressure medium distribution required for flatness of the upper press platen and as a function of at least the press platen temperature, press cycle rate, and the specific pressed product. The press in the described embodiment includes eleven transverse rows of press cylinders succeeding one another in the longitudinal press axis, each row in turn consisting of four press cylinders.

An ongoing problem involves inspecting and maintaining the individual components of the cycle press. This is true, in particular for the press cylinders. In order to perform maintenance work on the interior of the cylinders, it has typically been necessary, for example, to completely remove the press cylinders from the press. Since such action is relatively costly and can result in an extended downtime period for the entire press, alternative solutions have been proposed where the pistons can be removed from the casing from an installed cylinder (see DE 10 2004 033 484).

The cycle presses known in practice have proven basically successful. They are, however, capable of being improved. One particular problem is the fact that construction in configuring the press for especially high press pressures is so expensive that repair and maintenance work is possible only at huge expense. The invention seeks to provide a remedy here.

OBJECT OF THE INVENTION

The object of the invention is to create a cycle press, in particular a short-cycle press for making and/or laminating panel workpieces, in particular engineered wood boards, the press being designed so as to be user-friendly in terms of installation and maintenance even when designed for high press pressures.

SUMMARY OF THE INVENTION

This object is achieved according to the invention for a generic cycle press of the type referenced above by an approach where the press cylinders are mounted on the press frames by support bars that engage holes of the press frames. The press cylinders are preferably prestressed by support bars against the press frames.

This invention is based on the idea that the press cylinders can be easily and reliably mounted to the press frames if separate support bars are employed that are (removably) fitted in appropriate holes of the press frames, thereby enabling the press cylinders to then be pressed against these support bars and thus against the press frames. Each of the individual support bars here especially preferably engages two respective aligned holes of two immediately adjacent press frames, one press cylinder being supported jointly on this pair of adjacent press frames. This enables the press cylinders to be easily prestressed against the press frames, thereby reliably mounting the cylinders. This aspect is especially advantageous whenever the press is configured for very high pressing forces. This is because the inventive approach achieves reliable mounting of the press cylinders of high weight, large diameter, and large wall thickness.

The press cylinders are preferably each prestressed against the press frames by a plurality of tensioning screws that are screwed into the respective casing and pass through the respective support bars. The casings, for example, can have a plurality of screwthreaded bores at one end, for example four distributed around the outer periphery, and into which respective tensioning screws or rods are screwed. Each cylinder is preferably attached by a plurality of support bars, for example two support bars, with a respective plurality of tensioning screws, for example two tensioning screws, for each support bar.

In an especially preferred development of the invention, the support bars and the holes in the frame are complementary so that the support bars can be removed between the associated two press frames. To this end, the holes can be provided, for example in the form of slots such that they have a greater dimension vertically than the diameter of the actual support bars. In an alternative or supplementary approach, the ends of the support bars or at least one end can be of a reduced diameter. This diameter reduction can, for example involve chamfering the support bar at one end. This configuration comprising both hole slots and/or diameter reductions at the ends of the support bars means that the support bars—after undoing the screws—can be removed relatively easily by appropriately tilting and/or twisting them out of the holes, then removing them from between the press frames, for example upward and away. This approach thus provides especially reliable mounting of the cylinders to the press frames while at the same allowing this attachment to be easily undone for maintenance purposes, thereby allowing removal of the cylinders to be effected by relatively simple means.

The cylinders or their casings themselves are provided with lateral flats, either in cross-section or as viewed from the top, with the result that the cylinders are of greater diameter cross-sectionally in radial direction than in a perpendicular radial direction. The casings can thus be engaged under the frames for attachment and also be rotated by 90° for removal, thereby allowing the casings or the entire cylinders to then be pulled from the press upward between two adjacent press frames.

The support bars can be solid, for example steel rods. Alternatively, the support bars can also be tubes or pipe sections. In both cases, it may be advantageous to screw the support bars to the clamping bolts with additional force-distributing plates interposed. The force-distributing plates can either be complementary to the shape of the threaded bolts or they can themselves be deformed during attachment. The force-distributing plates in any case enable effective seating surfaces to be provided for the screws or nuts, specifically when circular-section support bars are used.

In an especially advantageous approach, the cylinders fit in the frame windows of the press frames. Thus according to the invention the cylinders themselves with their casings are clear in the space between the press frames. This embodiment is especially advantageous whenever the cylinders are designed for very high pressing forces. A press is thus preferably provided according to the invention that is designed for a specific pressing force greater than 600 $N/cm^2$, especially preferably 700 $N/cm^2$ and higher.

In accordance with a further proposal, the press includes at least two hydraulic tanks that are mounted in longitudinally centered fashion on the press body, but instead are preferably disposed to the sides of the press and are thus laterally offset to the vertical central plane of the press cylinders. In contrast to a conventional embodiment having a transversely centered hydraulic tank, this embodiment has the advantage that the installation space above the cylinders is freely accessible, thereby allowing all of the press cylinders to be removed upward from the press body. This action can be performed, for example by a lifting equipment, for example a shop crane or a ceiling crane. The approach is, however, also within the scope of the invention where a special lifting device is mounted on the press body or is installed in the area of the press. A construction is in any case implemented within the scope of the invention whereby the press cylinders can be easily removed completely from the press, and specifically by upward removal of the press cylinders from the press body after the attachment has been released and after the mounts have been disconnected from each heating platen.

The invention basically comprises an approach where the hydraulic tanks are mounted on top of the press frames. However, the hydraulic tanks are especially preferably not mounted directly on the press frames but instead on connecting bolts or rods that interconnect the press frames. This is because in an especially advantageous approach, the individual press frames are attached to each other by connecting bolts or tie rods that run longitudinally of the press. The hydraulic tanks can be installed by appropriate tank supports on these connecting bolts, thereby ensuring relief of the load on the individual press frames and avoiding any damage.

The press is preferably provided in the form of a multi-piston press. This means that the individual transversely extending press-cylinder rows do not each comprise only two press cylinders, but instead at least three, and especially preferably, four press cylinders. Ten such transversely extending rows of press cylinders or more, for example can then be aligned longitudinally along the press axis. This type of multi-piston press comprising 40 cylinders or more enables the press to be adapted to a variety of board formats to be pressed. To this end, the various press cylinders can also be subject to different controls. For example, a plurality of hydraulic systems or press systems which are adjustable independently of each other can be used, for example six press systems or more that are adjustable independently of each other.

In overall terms, a short-cycle press is created that is configured for especially high pressing loads of 700 $N/cm^2$ or more. This press is well-suited, in particular for the short-cycle laminating of engineered wood boards including, for example decor papers. Short-cycle laminating is employed, for example, for making laminate floors, wall panels, furniture, or doors.

The press according to the invention is designed especially preferably as a downstroke press, i.e., the press cylinders act on the upper heating platen while the (stationary) lower heating platen rests on the lower cross-members of the press frames. The press cylinders here are typically provided in the form of single-acting hydraulic cylinders whose pressing forces can only be applied in one direction. Additional pull-back cylinders are typically provided for opening the press. The invention basically also, however, includes press cylinders that are double-acting, for example differential cylinders, thereby optionally allowing pull-back cylinders to be eliminated. The invention obviously also comprises upstroke presses in which the press cylinders act on the lower press platen.

BRIEF DESCRIPTION OF THE DRAWING

The following describes the invention in more detail with reference to a drawing that shows only one illustrated embodiment. Therein.

SPECIFIC DESCRIPTION OF THE INVENTION

Figure 1:
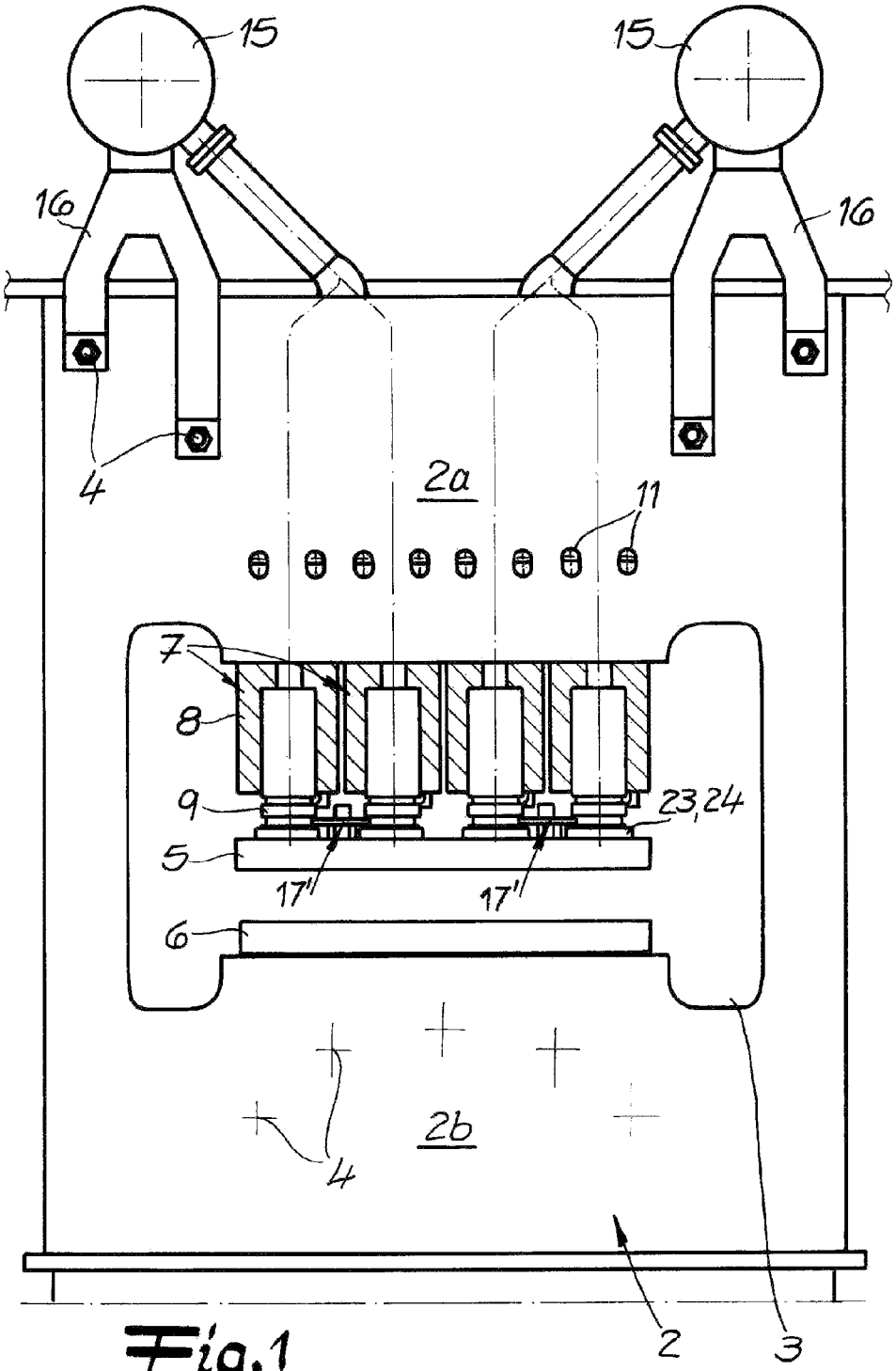
FIG. 1 is an end view of the short-cycle press according to the invention.
Figure 2:
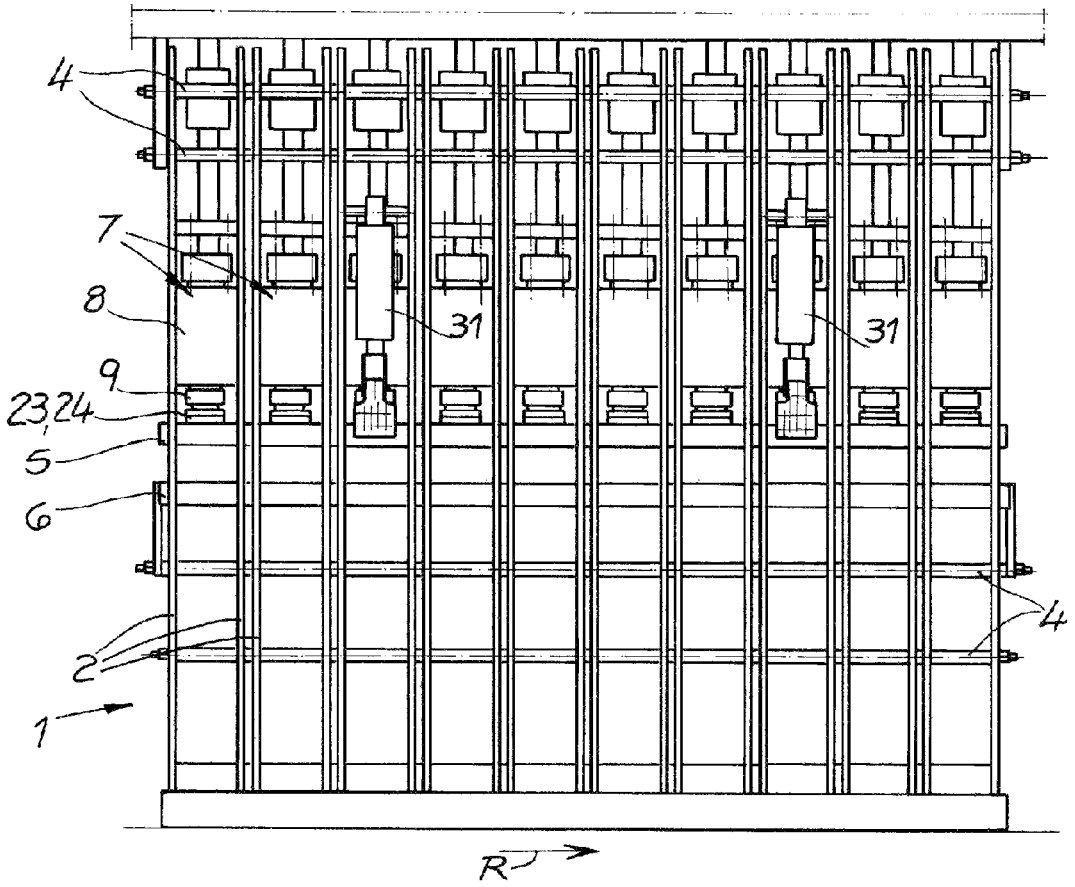
FIG. 2 is a side view of the press according to the invention.

The figures shows a short-cycle press in the form of a single daylight press for making or laminating engineered wood boards. In its basic construction, this short-cycle press includes a press body 1 formed by a plurality of press frames 2 that are arranged in a row extending along a longitudinal press axis R. The axis R corresponds to the working direction, and thus the loading and removal direction of the press. Press frames 2 in the embodiment are made from cut-to-size sheet steel, and specifically, using a "window design," i.e. the individual press frames 2 each form one window 3 defined at the top by an upper cross-member 2*a* and on the bottom by a lower cross-member 2*b*. The individual press frames 2 are connected to each other by tie rods 4 extending parallel to the longitudinal press axis R. To this end, spacer tubes are mounted on the tie rods 4 between the frames 2.

The press includes an upper press platen 5 and a lower press platen 6. These press platens 5 and 6 are heated. The press is equipped with a plurality of press cylinders 7 that in the illustrated embodiment are in the form of single-acting hydraulic cylinders 7. Each press cylinder 7 includes both a cylindrical casing 8 and also a piston 9. The press is designed as a downstroke press, i.e. the press cylinders 7 are connected by their pistons 9 to the (movable) upper press platen 5, while the lower press platen 6 rests essentially stationary on the lower cross-members 2*b* of the frames 2. The press cylinders 7 are in the windows 3 below the upper cross-members 2*a*, i.e. they are braced when the pressing force is applied by their upper ends on the upper cross-members 2*a* of the press frames (see FIGS. 3 through 5).

Figure 3:
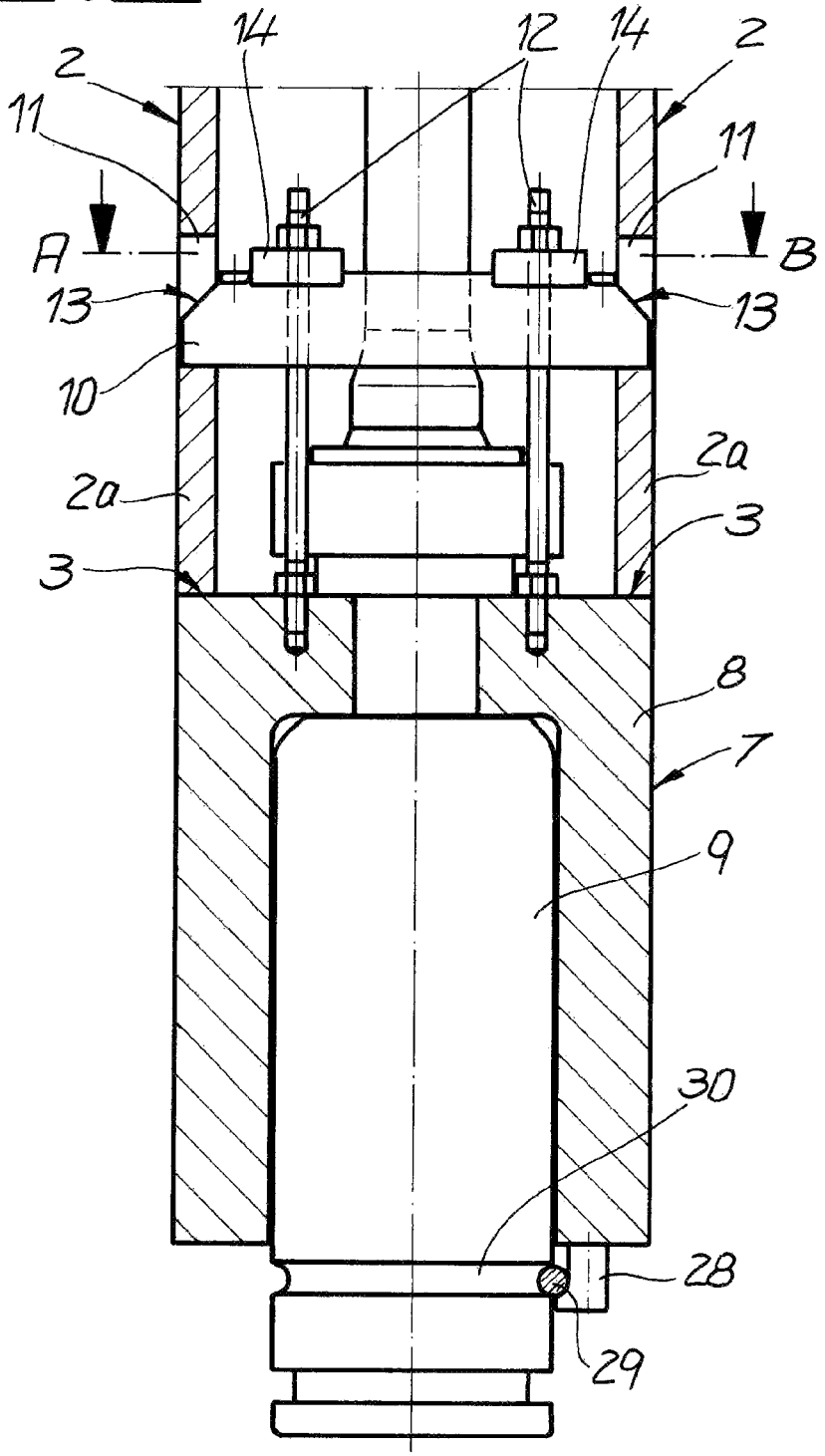
FIG. 3 is an enlarged detail of the structure of FIG. 2.
Figure 4:
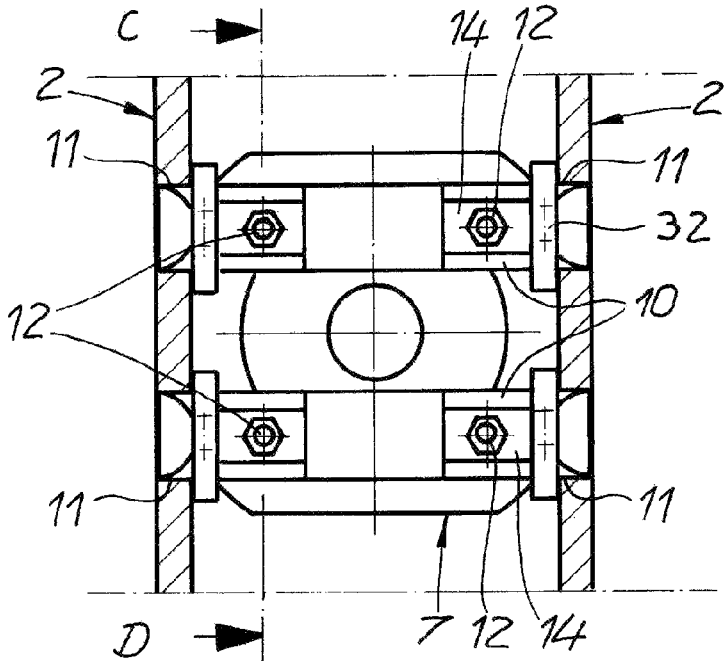
FIG. 4 is section A-B through the structure of FIG. 3.
Figure 5:
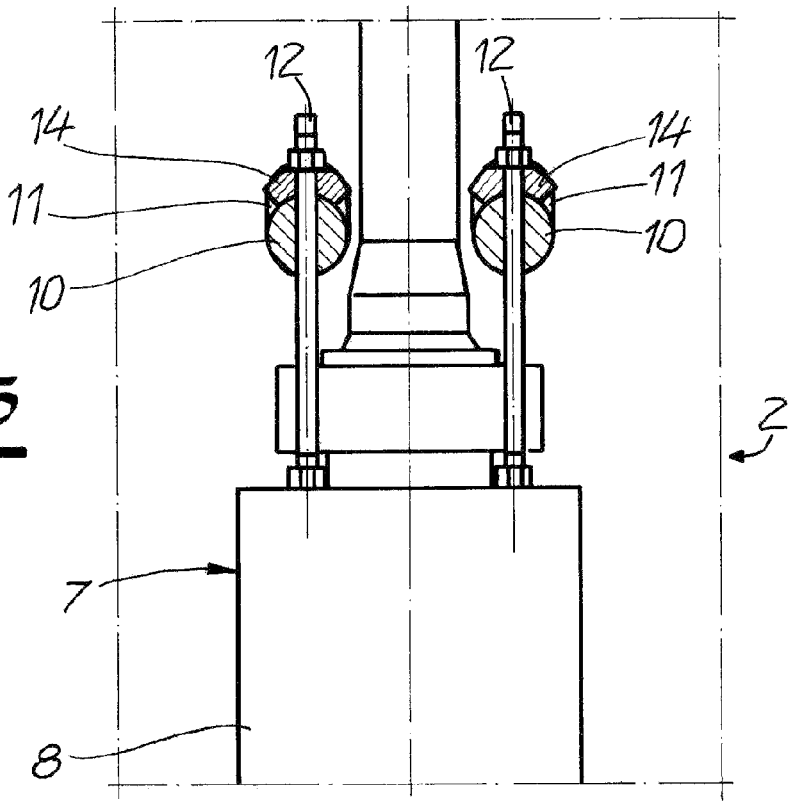
FIG. 5 is section C-D through the structure of FIG. 4.

FIGS. 3 through 5 here show that each press cylinder 7 or its casing 8 is supported on two adjacent press frames 2. To this end, the cylinders or their casings 8 are of a diameter in at least one direction that is greater than the spacing between adjacent press frames. This is seen, for example, in FIG. 4 that furthermore shows that the casings are "flattened" in certain areas, i.e. the diameter is smaller in one direction than the diameter in another direction perpendicular thereto—in particular the diameter along the one axis is smaller than the spacing between two adjacent press frames, thereby enabling the cylinders—starting from the functional position of FIG. 4—to be rotated 90° so as to allow them to be removed. This will be explained in more detail below.

FIGS. 3 through 5 furthermore illustrate that the cylinders are mounted by support rods or bars 10 to the press frames 2 with ends of the rods 10 engaged in respective aligned holes 11 of the press frames 2. The cylinders, or their casings 8, are attached by tensioning screws 12 to the rods 10 such that the cylinders 7 are prestressed against the frames 2 by the tensioning screws 12 and the support bars 10. A comparison of FIGS. 3 through 5 furthermore shows that each press cylinder 7 is attached to two support bars 10, and two tensioning screws 12 are in turn provided for each support bar 10. The holes 11 in the embodiment are oval or slots that are of greater length vertically than horizontally. FIG. 3 also reveals that the ends of the support bars 10 are provided with reduced diameter ends 13 that are formed as chamfers in the illustrated embodiment. This configuration comprising both chamfers 13 and slot-like holes 11 means that support bars 10 can be removed between respective press the frames 2 by appropriately tilting and/or rotating them. This construction provides an especially secure attachment of the cylinders to the frames 2 and also enables the system to be easily disassembled, thereby allowing the cylinders to be removed from the press upward between the frames 2 for maintenance purposes.

The support bars 10 in the illustrated embodiment are provided in the form of solid rods. The length of the rods corresponds to the spacing between outer faces of two adjacent press frames. The support bars 10 are screwed to tensioning screws 12 with interposition of force-distributing plates 14. These ensure there is an effective support surface for the nuts or tensioning screws on the support bars 10, which here are of circular cross-section. Retainers 32 in the form of plates are attached to the support bars 10, for example by screws. These function to secure the rods 10 axially, thereby preventing the rods 10 from sliding out of the holes when installed. The plates 32 can be wider than the holes 11 for this purpose. They rest on the inside against the frames 2. The plates 32 must then be released in order to remove the support bars 10.

The illustrated embodiment dispenses with the otherwise typical central hydraulic tank in order to allow the cylinders to be easily removed upward from the press for purposes of maintenance or replacement. What is essentially a double tank is provided instead. FIG. 1 thus shows that two hydraulic tanks 15 are provided that are mounted above the press body 1, and specifically not at the center over the press but offset laterally and consequently to the side. In the end view of FIG. 1, the hydraulic tanks 15 are thus not immediately above the cylinders but rather laterally offset relative to them. The illustration furthermore shows that hydraulic tanks 15 are not mounted directly on the frames 2; instead these hydraulic tanks 15 are mounted by supports 16 on the tie rods 4, or are mounted on them. As a result, damage to the frames 2 itself is prevented. In overall terms, a comparison of FIGS. 1 through 5 clearly shows that the cylinders can be especially easily removed upward out of the press in the embodiment of the invention. This is achieved despite the fact that the press itself, and thus also the press cylinders, press frames, and remaining components are designed for especially high pressing forces of 700 N/cm$^2$ and higher.

It is obviously necessary to disconnect the cylinders or their pistons 9 from the (upper) press platen 5 before removal. This is explained in more detail below, in particular based on FIGS. 6 through 8.

Figure 6:
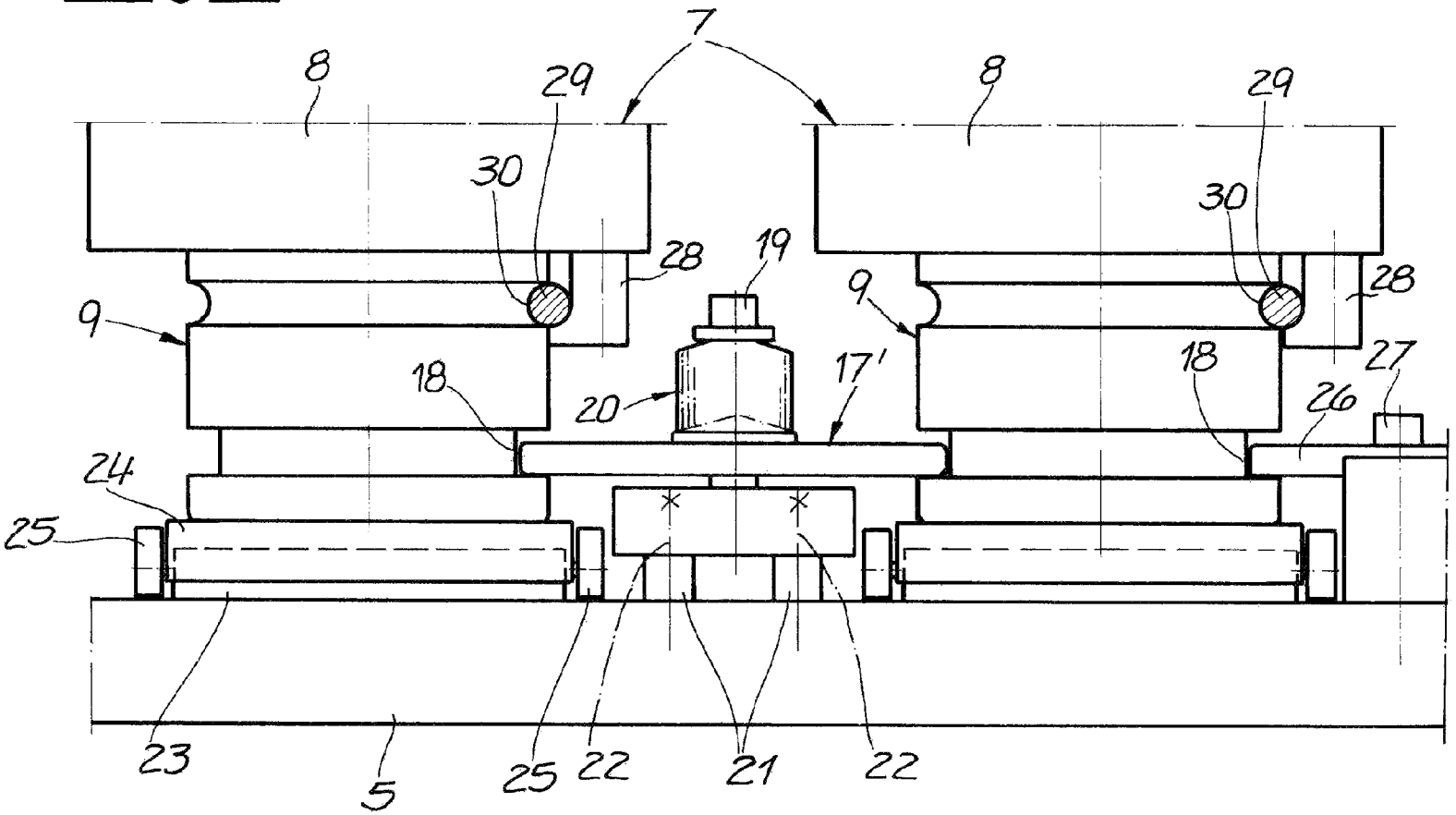
FIG. 6 is an enlarged detail of the structure of FIG. 1.
Figure 7:
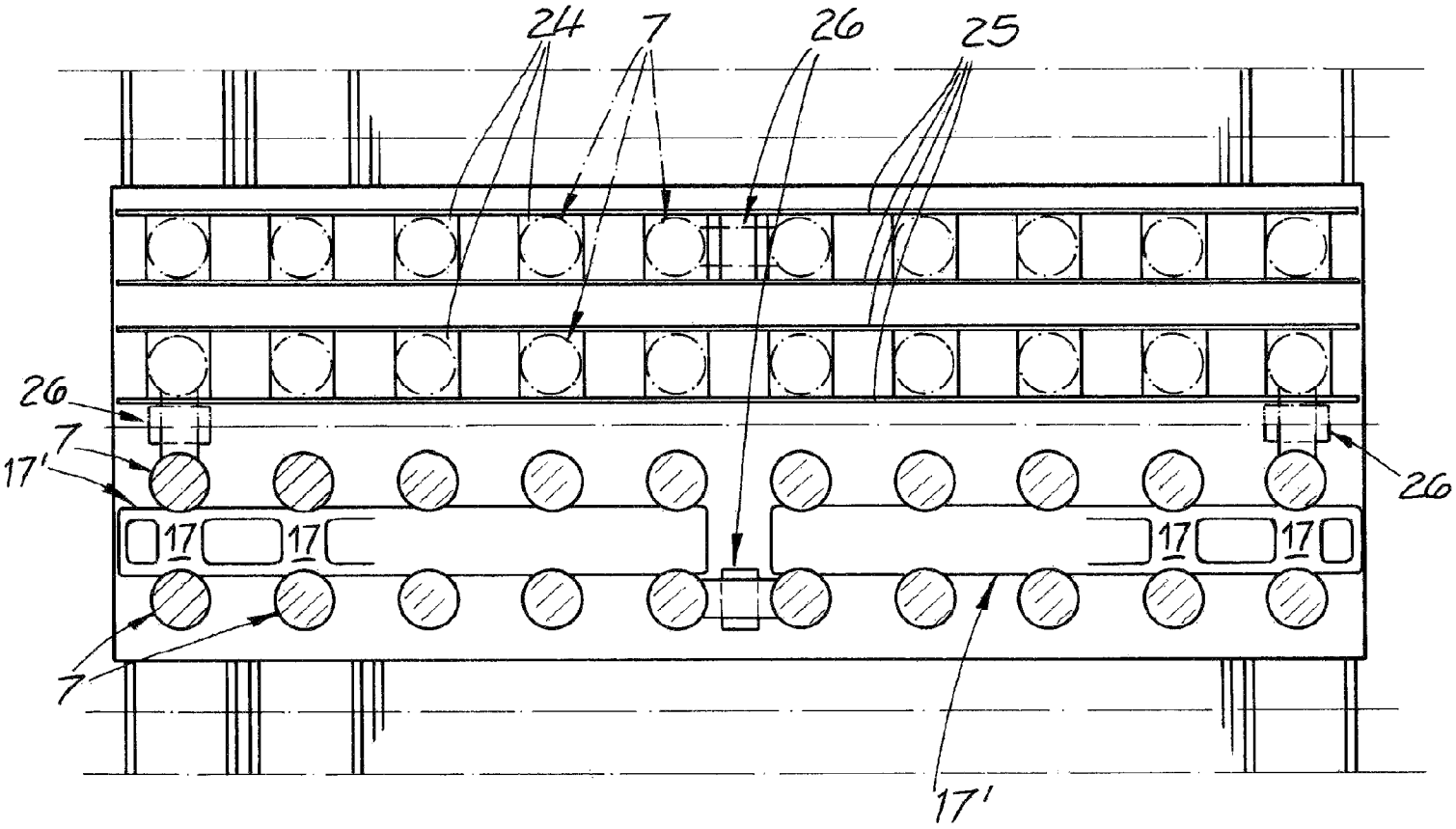
FIG. 7 shows a simplified horizontal section through the structure of FIG. 1.
Figure 8:
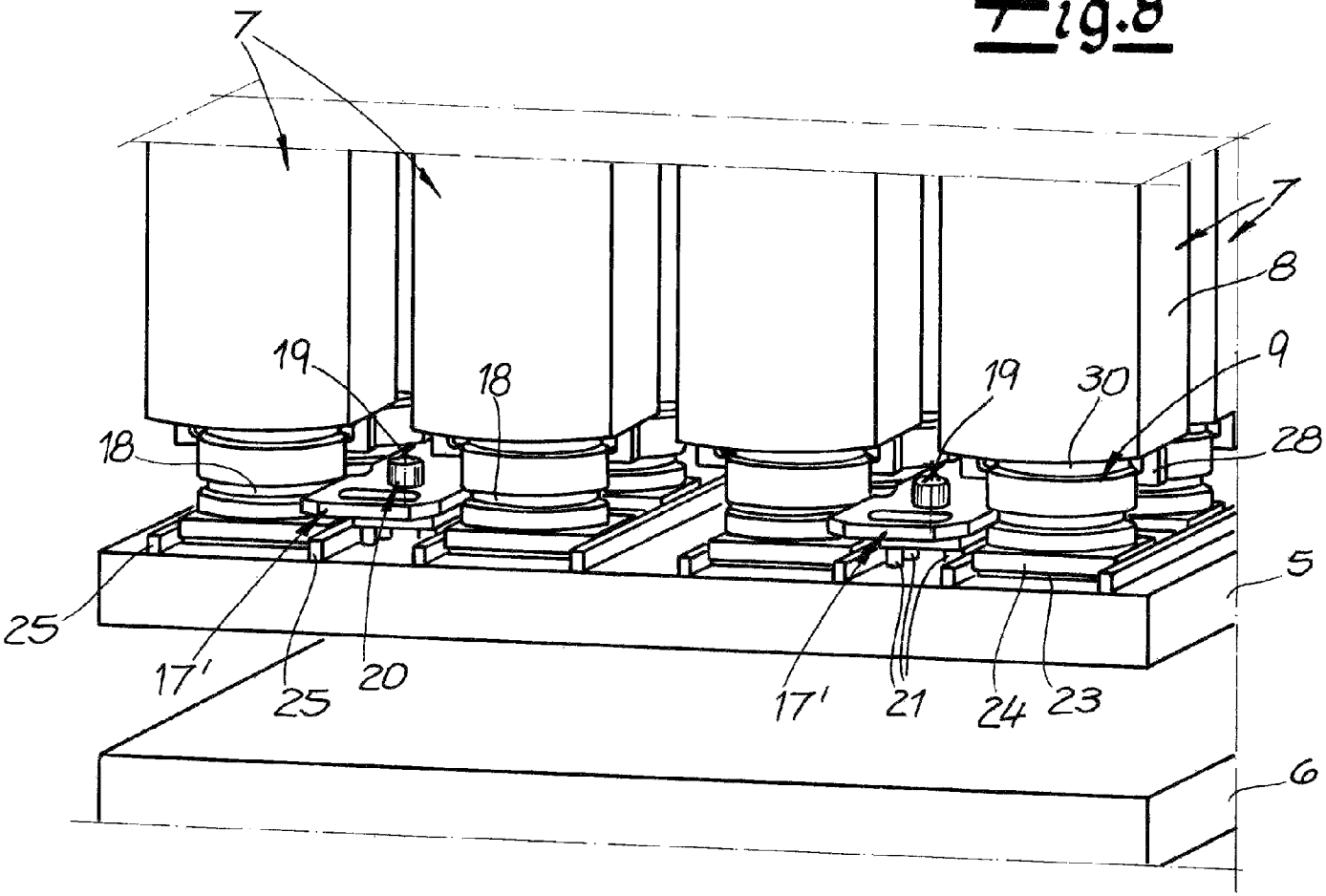
FIG. 8 is a simplified perspective view of the structure of FIG. 6.

FIGS. 6 through 8 show that the upper platen 5 is attached to the pistons 9 by latch plates 17 that fit complementarily in respective seat grooves 18 of the pistons or extensions at the ends of the pistons. The plates 17 are bolted to the press platen 5 by screws 19, springs 20, for example stacks of Belleville washers. Accordingly, the attachment of the pistons 9 is no longer effected by complex means using interposed mounting elements; instead, the plates 17 are slid into position between adjacent cylinders and each function to simultaneously attach more than one piston 9, specifically, two adjacent pistons. This provides simple installation and removal, even when the cylinders 7 and their the pistons 9 are of especially large size so as to achieve especially high pressing forces. Of special significance in the embodiment is the fact that a plurality of the plates 17 are combined to create a common flat mounting rail 17' for attaching the mounting press platen 5 to all the pistons 9 in a row extending along the longitudinal press axis, this flat mounting rail 17' extending parallel to the longitudinal press axis along a number of the cylinders. FIG. 7 shows here that one flat mounting rail 17' extends longitudinally across through five rows of cylinders, with the result that a total of ten pistons are attached to the press platen 5 by one flat mounting rail 17'. This embodiment in particular has the advantage that the flat mounting rail 17' can in overall terms be extracted from and inserted into the press from the end, thereby providing easy installation and removal, in particular when overall installation space is reduced. FIG. 6 shows here that the plates 17 or flat mounting rails 17' are not bolted directly by the screws 19 into the heating platens but only via interpose spacers 21 that in turn are attached by the screws 22 to the platens 5. This prevents the heating platen 5 from being overloaded by one tensioning screw 19 torqued down to exert a high tensioning force.

FIGS. 6 and 7 furthermore show that not only the mounting of the heating platen is optimized; in fact, the mounting or replacement of piston insulators is optimized as well in the press according to the invention. There are thus no longer any conventional insulator plates that are each screwed onto a respective piston end; instead, insulator plates 23 are held in respective seats 24 that are interconnected by longitudinal rails 25 to form a multi-cassette frame 24, 25. This is shown in particular in FIG. 7. The insulators are thus not attached to the ends of the pistons 9; instead they are set onto the upper platen 5 during installation, then compressed between the end of the respective piston and the press platen when the pistons 9 are mounted on the platen 5. An especially advantageous aspect is the fact that, after connections have been released, a plurality of insulator plates 23 can be removed and reinserted together, specifically by use of the of described cassette frame 24, 25. The often typically required replacement of the insulator plates, which are subject to wear, is considerably simplified, with the result that maintenance times are shortened. This aspect too is achieved despite the press being sized for high pressing forces such that there is typically little space available for maintenance work in the region of the press cylinders.

FIGS. 6 and 7 furthermore show that, in addition to the plates 17 and insulator plates 23, centering plates 26 are provided that engage the seat grooves 18. These centering plates 26 are also mounted on the platens 5 by screws 27. The centering plates 26 function to optimally position the press platen 5 both relative to the longitudinal axis and also to the transverse axis. This is shown, in FIG. 7 where two of the centering plates 26 are provided for transverse positioning axis and also for longitudinal positioning.

Finally, FIG. 6 shows that holding brackets 28 are attached at lower ends of the casings 8 of the cylinders. The purpose of these holding brackets 28 is to secure the pistons 9 in their retracted position, or even in a different position. This holding action is required in order to allow the press cylinders as an entire unit, i.e. the casing 8 together with its piston 9, to be removed from the press without the piston 9 falling out and downward from the casing after disconnection from the heating platen. An especially advantageous aspect is the fact that the holding brackets 28 can remain "permanently" installed on the casing. It is thus not necessary to install the brackets themselves to get the holding action; instead, all that is required is to insert a slide-in rod 29 that in a lockingly engages both the holding brackets 28 and an (additional) groove 30 in the piston or its end extension piece. An interesting aspect is the fact that this slide-in rod 29 can be inserted from the end into the press, thereby enabling a number of the pistons 9 in a row to be secured or even all of a longitudinal row of the pistons to be secured together by a single slide-in rod 29. In particular no extra screw-type attachments are required on the individual cylinders in order to effect the described holding action.

The figures furthermore illustrate that the press is also equipped with pull-back cylinders 31. This is because the cylinders here are single-acting so that only pressing forces can be applied. Pull-back cylinders 31 are thus used to open the press.

Figure 9A:
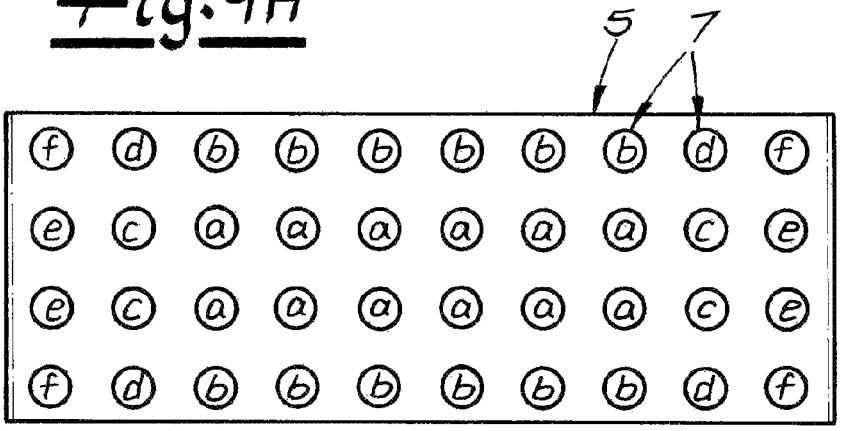
FIGS. 9A, 9B, and 9C show a highly simplified horizontal section through the press as it handles various board formats.
Figure 9B:
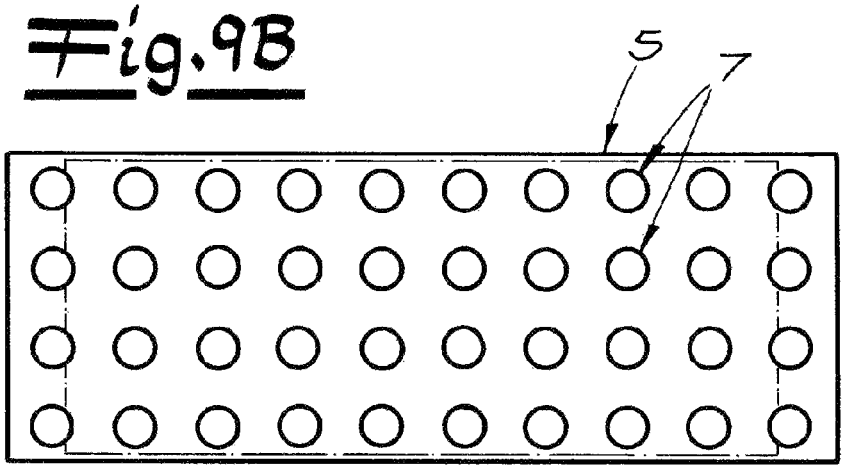
Figure 9C:
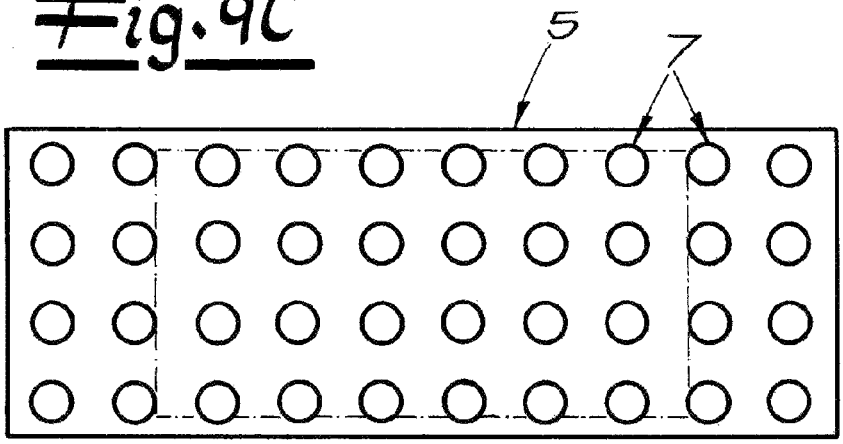

FIGS. 9A, 9B, and 9C furthermore show that engineered wood boards in a wide variety of formats can be made or laminated by this press that as a multi-piston press is fitted, for example with forty press cylinders. Appropriately selecting the press cylinders enables boards to be easily pressed, even when these involve widely different board sizes. It can be advantageous for this purpose to group the press cylinders into a plurality of press cylinder groups so as to allow individual groups to be controlled separately and independently of each other. This is indicated FIGS. 9A, 9B and 9C by the letters a through f which represent different press systems. In addition, the operation preferably works with heating platens of high quality and very high surface smoothness. The heating platens can have a contact area ratio of between 97% and 100%. The press cylinders are mounted on the press frame to permit some canting. Control of the press cylinders is effected by proportional valves.

The invention claimed is:

1. A cycle press for making and/or laminating panel workpieces, the press comprising:

a body having a row extending along an axis of frames each formed with windows and with respective cutouts offset vertically from the windows;

an upper platen extending through the windows;

a lower platen extending through the windows;

a cylinders supported on the frames and also acting on the upper or lower platen; and support bars supporting the cylinders on the frames and also having ends engaging the cutouts in the respective frames, one end of each of the bars being dimensioned smaller than the respective cutout for removal of the bars from between the respective frames.

2. The press according to claim 1, further comprising:

means for prestressing the cylinders via the support bars against the respective frames.

3. The press according to claim 1, wherein each cylinder is mounted on the frames by at least two of the support bars.

4. The press according to claim 2, wherein the means for prestressing includes a plurality of tensioning screws that are screwed into casings of the cylinders and pass through the respective support bars.

5. The press according to claim 1, wherein the cutouts are slots.

6. The press according to claim 1, wherein the one end of each of the support bars is provided with a respective reduced diameter region.

7. The press according to claim 6, wherein each reduced diameter region is formed by a chamfer.

8. The press according to claim 1, wherein the support bars are solid rods or tubes.

9. The press according to claim 4, further comprising:

force-distributing plates interposed between the support bars and the respective tensioning screws.

10. The press according to claim 1, further comprising:

tie rods or connecting bolts attaching the frames to each other and extending along the longitudinal press axis of the body.

11. The press according to claim 1, further comprising:

at least two hydraulic tanks for supplying the cylinders and laterally offset relative to the cylinders.

12. The press according to claim 11, wherein the hydraulic tanks are mounted on connecting bolts or tie rods of the body by tank supports.

13. The press according to claim 1, further comprising:

one or more retaining plates attached to the support bars when installed so as to secure the support bars within the cutouts.

14. A cycle press for manufacturing engineered wood boards, the press comprising:

a longitudinally extending row of pairs of transversely extending and longitudinally spaced vertical frames each having a transversely extending upper cross member and a transversely extending lower cross member forming with the respective upper cross member a longitudinally open window, each a frame further being formed with a longitudinally open hole vertically offset from the window;

an upper platen extending through the windows;

a lower platen below the upper platen and extending through the windows, one of the platens being movable and the other of the platens being fixed;

respective cylinders between the frames of each of the pairs of frames and bearing vertically on the movable platen; and longitudinally extending support bars supporting the cylinders on the frames and having ends engaging into the holes in the frames of the respective pair of frames and dimensioned for withdrawal of the bars from between the frames of the respective pair.

15. The cycle press defined in claim 14, wherein the holes and the cylinders are above the windows.

16. The cycle press defined in claim 14, wherein each of the cylinders is centered between a respective pair of the frames and has a casing with an end anchored to a respective pair of the support bars.

17. The cycle press defined in claim 16, further comprising:

two tensioning fasteners each fixed between a respective one of the support bars and the respective casing.

18. The cycle press defined in claim 17 wherein each of the casings is generally cylindrical with a diameter greater than a longitudinal spacing between the frames of the respective pair of frames but formed with a flat such that rotation of the cylinder allows the cylinder to fit between and be withdrawn vertically out from between the frames of the respective pair of frames.

19. The cycle press defined in claim 14, wherein each of the holes is a vertically elongated slot vertically taller than a vertical height of the respective end of the respective support bar engaged therein.

* * * * *